US005493879A

United States Patent [19]

Bison

[11] Patent Number: 5,493,879

[45] Date of Patent: Feb. 27, 1996

[54] DUAL LOCK SECURITY RACK ARM

[76] Inventor: Jerome W. Bison, 12660 Branford St., Pacoima, Calif. 91331

[21] Appl. No.: 328,117

[22] Filed: Oct. 24, 1994

[51] Int. Cl.[6] ..... E05B 73/00

[52] U.S. Cl. ..... 70/62; 70/58; 70/59; 211/7

[58] Field of Search ..... 70/57–62, 232, 70/234, 235, 233; 211/4, 7; 248/551

[56] References Cited

U.S. PATENT DOCUMENTS

| | | | |
|---|---|---|---|
| 1,204,813 | 11/1916 | Murray | 211/4 X |
| 3,567,034 | 3/1971 | Mozelsio | 211/7 |
| 4,069,919 | 1/1978 | Fernbaugh | 70/62 X |
| 4,260,063 | 4/1981 | Bennett et al. | 211/4 |
| 4,540,092 | 9/1985 | DeSantis | 70/62 X |
| 4,740,020 | 4/1988 | Williams | 70/289 X |
| 5,018,627 | 5/1991 | Moore | 211/7 X |

FOREIGN PATENT DOCUMENTS

| | | | |
|---|---|---|---|
| 2446094 | 9/1980 | France | 211/7 |
| 681952 | 6/1993 | Switzerland | 211/4 |
| 2058560 | 4/1981 | United Kingdom | 211/4 |

*Primary Examiner*—Lloyd A. Gall
*Attorney, Agent, or Firm*—Roger A. Marrs

[57] ABSTRACT

A security rack arm is disclosed herein having an elongated channel base provided with a plurality of open vertical slots in fixed spaced-apart relationship. A slide bar is movably disposed on the base and is provided with a plurality of apertures with upper and lower lugs extending towards one another from opposite sides of each aperture to define a lower locked storage cavity and an upper release or unlocked cavity. A lock latch mechanism carried on the slide bar cooperates with the base to selectively align the release cavity with the open vertical slot to permit passage of a garment hook normally disposed in the storage cavity through the aperture into the open vertical slot for separation from the rack. An expansion spring carried between the base and the slide bar normally biases the upper and lower lugs to close the open vertical slot depending upon the lock latch mechanism.

8 Claims, 2 Drawing Sheets

DUAL LOCK SECURITY RACK ARM

BACKGROUND OF THE INVENTION

1. Field of the Invention

The present invention relates to the field of security devices, and more particularly to a novel garment rack having the capability of permitting the removing of a single item while other items on the rack will be in a locked position.

2. Brief Description of the Prior Art

In the past, a variety of garment racks has been in use which provide an elongated bar in which a plurality of slots have been formed for the purpose of holding the hook of hangers on which garments are displayed. In order to inspect the garment, the customer may raise the hook through the open slot for removal from the storage rack. Problems and difficulties have been encountered with such a conventional storage system, which stems largely from the fact that a customer may remove several garments on hangers from the rack at the same time. This has created a security problem and encourages theft whereby multiple garments can be grasped by unauthorized personnel and removed from the rack in a short period of time.

Therefore, it is very desirable to provide a storage rack for a multiplicity of garments on hangers whereby only a single garment can be removed from the rack at one time while the remaining garments are in a locked and secure position.

SUMMARY OF THE INVENTION

Accordingly, the above-mentioned problems and difficulties are avoided by the present invention which provides a novel dual-lock security rack arm which has an elongated stationary support base which mounts a movable slide bar. The base includes a plurality of spaced-apart open vertical slots, while the slide bar includes a plurality of spaced-apart open apertures which are placed in alignment with or out of alignment with the open vertical slots of the base when the slide bar is moved between an aligned or a misaligned position by means of a manual lock latch mechanism. The aperture includes an upper and a lower lug extending outwardly from opposite sides of the aperture so as to define a lower storage cavity and an upper release cavity. The upper release cavity is placed in alignment with the open vertical slot when the lock mechanism is in one position and the lower storage cavity is blocked from the open vertical slot by the lower lug. When the lock latch mechanism is in the release position, the upper release cavity is aligned with the open vertical slot permitting release of a selected one of garment hangers. A feature resides in the provision of the upper lug having the two positions of either blocking the open vertical cavity or unblocking the open vertical cavity with respect to the passage of a garment hanger, while the lower lug prevents unselected garment hangers from passage into the release cavity. The spring means normally biases the slide bar to close the opening of the open vertical slot by the upper lug and such bias is yieldable to the position of the lock latch mechanism in order to remove the upper lug from its locking position.

Therefore, it is a primary object of the present invention to provide a security rack for a plurality of garments on hangers which will permit a selected garment to be removed while all the others remain in a locked condition.

A further object of the present invention is to provide a novel two-way security rack for garments on hangers, which will prevent a customer or unauthorized personnel from removing more than one garment at a time from the storage rack.

Another object of the present invention is to provide a novel security rack for a plurality of garments whereby only a selected item or garment may be removed from the rack while the remaining items or garments stay in the locked condition.

Yet another object of the present invention is to provide a two-way security rack for a plurality of garments, which provides maximum sales person control over the removal of the garments from the rack.

Still a further object of the present invention is to provide a novel two-way security rack whereby the releasable locking of garments on the rack is a deterrent to prevent unauthorized personnel from removing the garments from the rack.

Another object of the present invention resides in providing a dual-lock security rack arm whereby the garments or products carried on the rack always stay locked and wherein the release of a selected item from the rack is allowed while the remaining items or garments on the rack are in their locked condition.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference in the following description, taken in connection with the accompanying drawings in which:

DESCRIPTION OF THE PREFERRED EMBODIMENT

Figure 1:
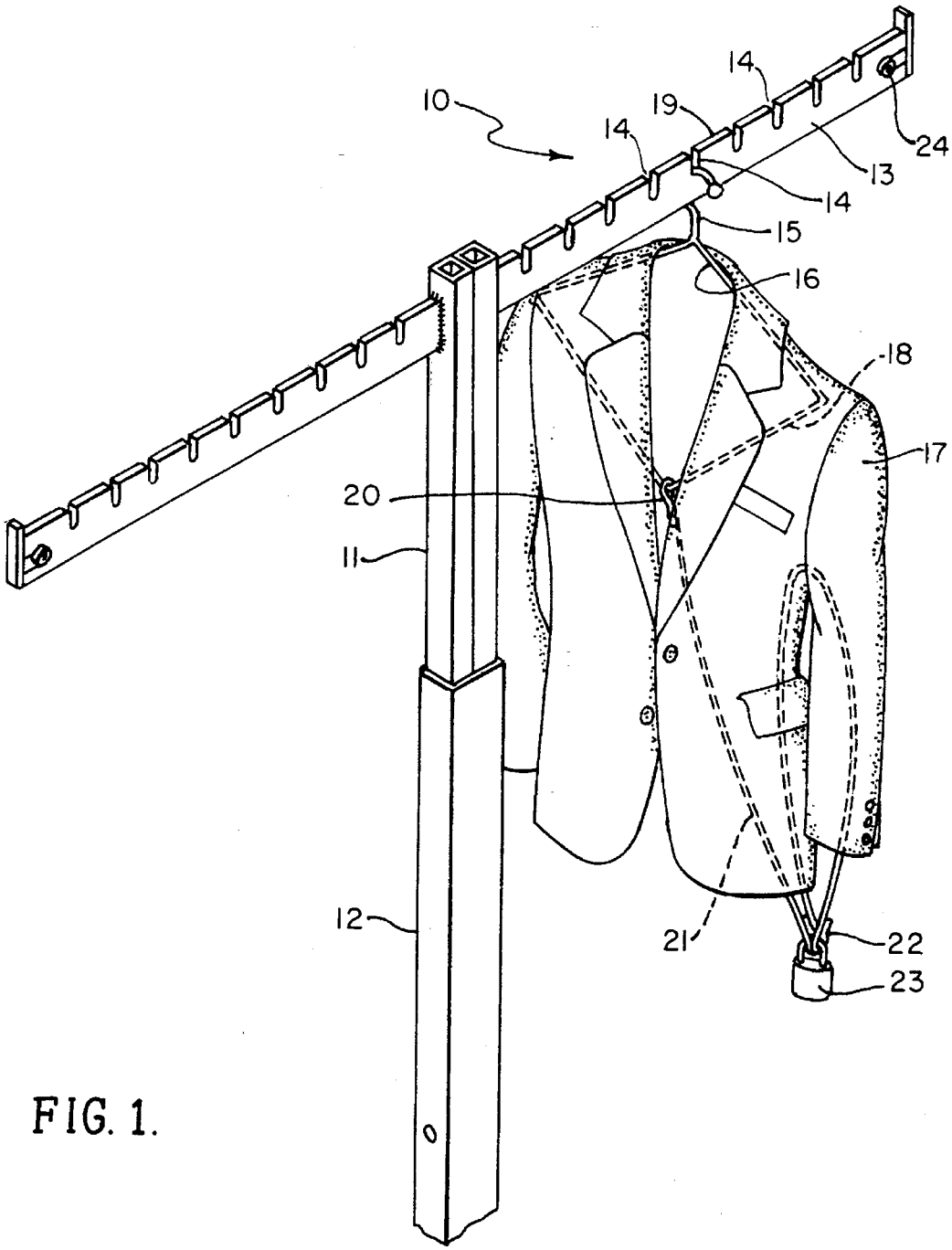
FIG. 1 is a front perspective view illustrating the novel dual-lock security arm of the present invention with a garment on a hanger suspended therefrom.

Referring to FIG. 1, the novel dual-lock security rack arm is illustrated in the general direction of arrow 10 and the rack is illustrated as being mounted on a telescoping pole having an upper section 11 and a stand section 12. The arm is cantilevered outwardly to one side and it can be seen that the arm includes an elongated base 13 having a plurality of open vertical slots, such as slot 14, through which a hook 15 of a hanger 16 downwardly depends. The hanger 16 supports a garment 17 and for security reasons, a cable 18 connected to the hanger 16 is passed through an eyelet 20 so that a cable 21 can be passed therethrough and trained through the sleeve of the garment where its opposite end can belocked to a fixture or fitting 22 by means of a padlock 23. It is to be understood that the hanger, garment and the garment security cable and padlock do not form a part of the present invention and it is illustrated in FIG. 1 for descriptive purposes only.

The hook 15 is supported on the base 13 within the open-ended slot 14. A plurality of slots are arranged to open along one edge of the base 13 in fixed spaced-apart relationship wherein each slot is intended to hold a single hook for supporting one garment. The base 13 includes a top edge marginal portion 19 between each of the slots. The entrance leading into each of the respective slots is slightly larger than the diameter of the hook 15 so that when the entrance is open, the hook 15 may readily be lifted from the base 13 and separated from the rack arm. Inspection of the garment can then take place when the garment is free from its support on the rack. Means are provided for locking the hook 15 in position within slot 14 and the lock means is illustrated by numeral 24 which takes the form of a latch operated by a key. When the locking means is in its lock position, no hooks or hangers can be removed from their storage location within the slots. However, when the locking mechanism is in its unlocked position, the hook 15 can be moved within the slot to a second location rendering it available for separation from the rack when the locking means 24 is activated a second time to a locked position. Details will be discussed in the following manner.

Figure 2:
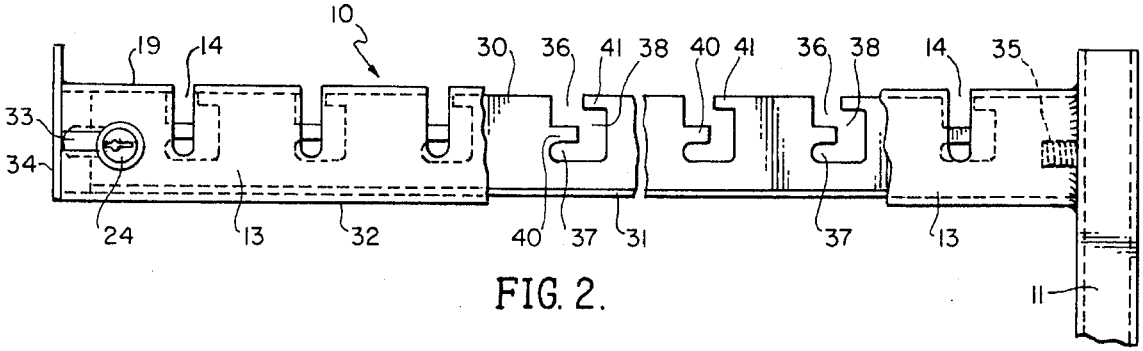
FIG. 2 is an enlarged side elevational view, partially broken away, illustrating the dual-lock mechanism incorporated into the arm shown in FIG. 1.
Figure 3:
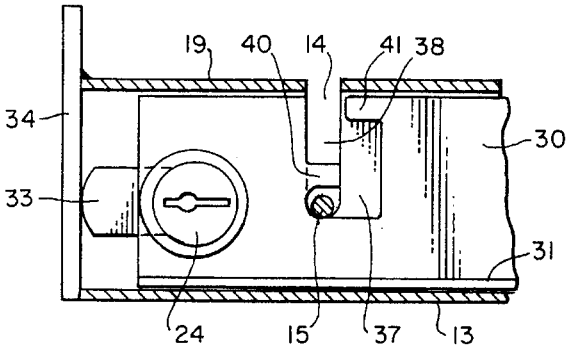
FIG. 3 is an enlarged fragmentary view, in section, of the rack arm shown in FIG. 2 with the hanger carrying a garment positioned in a locked storage cavity.
Figure 4:
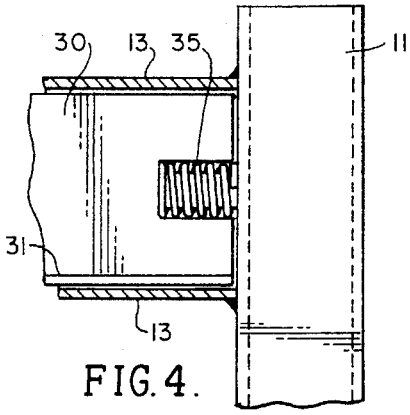
FIG. 4 is a side view, partly in section, illustrating the spring biasing means for normally biasing the slide bar.

Referring now in detail to FIG. 2, it can be seen that the base 13 is fixedly carried to the post 11 so that the base is stationary. The base 13 slidably supports a slider bar 30 which includes a runner 31 in sliding relationship with the underside or bottom of the base represented by numeral 32. The slider bar 30 is elongated and is of slightly shorter length than the base 13 so as to permit the movement or sliding of the slide bar 30 within the base 31 when a latch 33 movable by the rotary element in the lock mechanism 24 engages with the surface of a stop plate 34. Therefore, as the lock mechanism 24 is rotated after the insertion of a key, the latch 33 can be moved from the position as shown in FIG. 3 to the position shown in FIG. 5. When actuated to the position shown in FIG. 5, an expansion spring 35 disposed between the opposite end of slider bar 30 and, stanchion 11 urges the slider bar towards the stop plate 34 to the position shown in FIG. 5. Therefore, it can be seen that the slider bar 30 has two positions dependent upon the rotation of the latch 33.

FIG. 2 also reveals that the top edge of slide bar 30 includes a plurality of apertures, such as aperture 36, which is open through the upper edge thereof. Each aperture defines a storage cavity 37 and a release cavity 38. A lug or tongue 40 separates the storage cavity from the release cavity while an upper tongue or lug 41 defines along with lug 40, the release cavity 38. The release cavity is in communication with the entrance leading into aperture 36 from the upper edge of the slide bar.

Referring now in detail to FIG. 3, the latch 33 is shown in its extended position bearing against the surface of stop plate 34. This is the lock position for the slide bar 30 since the expansion of spring 35 forcibly urges the slide bar and the latch 33 against the stop plate 34. It is noted that the hook of the hanger, as identified by numeral 15, is within the storage chamber or cavity 37 and is also at the bottom of the open vertical slot 14. The hook 15 is captured in the storage cavity since the lug 40 crosses over the vertical slot 14 and the hook cannot pass upwardly and out of the slot 14. This same condition exists for each and any hooks that occupy the storage cavity and slot 14 along the length of the rack arm.

Figure 5:
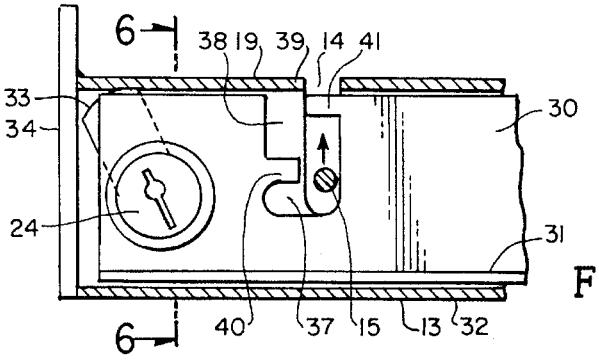
FIG. 5 is a view similar to the view of FIG. 3 illustrating the lock mechanism in a second position so as to permit the garment hanger hook to be moved from the storage cavity into the release cavity.

Referring now to FIG. 5, the lock mechanism 24 has been rotated to its alternate position in a clockwise direction away from the stop plate 34. This permits expansion of spring 35 to urge the slide bar towards the stop plate 34. It is to be particularly noted that the hook 15 may be moved upwardly out of the storage cavity 37 and into the release cavity 38 since the lug 40 has moved to the left out of the cross or interfering position in the slot 14. The hook 15 is raised upwardly to the position shown by the arrow. When the attendant or authorized personnel rotates the latch 33 counterclockwise to the original position as shown in FIG. 3, the hook 15 is now jointly in the release cavity 38 and the open vertical slot 14 so that the hook may be raised therethrough and separated from the rack. It is to be understood that since only the single hook 15 has been separated, any other hooks or items carried within the storage cavities are still locked in place and cannot be removed. Therefore, it can be seen that a first clockwise rotation of latch 33 permits movement of the hook 15 from the storage cavity into the release cavity and when the latch 33 is moved counterclockwise, the lug 40 again closes the storage cavity from the release cavity and the single hook 15 is available for removal as being the only item to be separated from the rack.

The intermediate position shown in FIG. 5 closes both the aperture 36 and the slot 14. The closure is effected by a shoulder portion 39 integral with the surface or upper edge 19 of the base and the upper lug 41 carried on the slide bar 30.

Figure 7:
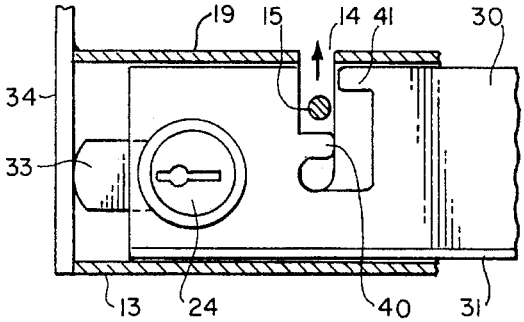
FIG. 7 is a view similar to the view of FIG. 5 illustrating the latch mechanism in a locked position yet permitting the hanger hook to be released from the release cavity for separation from the rack.

In FIG. 7, the hook 15 may now be raised and separated from the rack arm. The garment may be replaced by inserting the hook of the hanger back into the slot 14 so that it rests against the lower lug 40. Next, the lock mechanism can be rotated clockwise so that the slide bar 30 moves to the left towards the stop plate 34. This places the hook 15 into the release cavity and permits the hook 15 to drop past the lower lug 40 into the storage chamber. Next, the lock mechanism 24 is rotated counterclockwise so that the lower lug 40 crosses the vertical slot 14 to hold the hook 15 within the storage cavity, as shown in FIG. 3.

Figure 6:
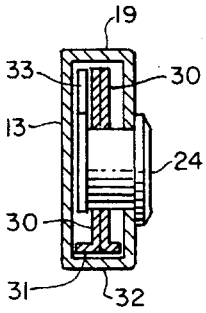
FIG. 6 is a transverse cross-sectional view of the rack arm shown in FIG. 5 as taken in the direction of arrows 6—6 thereof.

In FIG. 6, it can be seen that the base 13 is hollow and the slider 30 moves within the base. The lock mechanism 24 is carried on the base and the latch is rotated after authorized personnel have inserted a key into the key slot of the lock mechanism and rotated accordingly. In one form of the invention, the slider bar 30 may be composed of two pieces which are suitably joined together to form an integral one-piece construction.

In view of the foregoing, it can be seen that the novel security rack arm of the present invention will permit the removal of a single garment via its hook and hanger from the rack while the other garments are locked in place and are not removable. Therefore, unauthorized personnel are prevented from embracing several garments in one arm and lifting them from the support rack and making off with all of the garments.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the spirit and scope of this invention.

What is claimed is:

1. In a two-position security rack arm for releasably supporting an item to be separated from the rack arm comprising:

a bar member and a slider member mounted together for relative movement with respect to each other;

each of said bar and said slider members having open-ended passageways leading exteriorly of said bar and said slider members when aligned in a first position;

said slider member having an upper lug blocking each said bar member passageway in a passageway non-aligned position constituting a second position; and said slider member having a lower lug in spaced apart relationship with said upper lug partially blocking each said passageway of said bar member in said first position; said upper and lower lugs extending from said slider member in a direction parallel to the sliding movement of the slider member, and are spaced apart in a direction generally perpendicular to said movement.

2. The rack arm as defined in claim 1 including:

a lock mechanism carried on said slider member and having a rotatable latch selectively engagable with said bar member to alternately establish said first position and said second position; and spring biasing means interconnected between said bar member and said slider member to yieldably bias said slider member into said second position.

3. The rack arm as defined in claim 2 wherein:

said spring biasing means is an expansion spring having opposite ends bearing against said bar member and said slider member respectively.

4. The rack arm as defined in claim 3 wherein:

said slider member is provided with a storage cavity associated with each said lower lug and a release cavity associated with each said upper lug;

each lower lug terminating to define a space intercommunicating said storage cavity with said release cavity whereby the item to be separated is maintained in said storage cavity by said lower lug when said slider member is in said first position, permitted transfer from said storage cavity into said release cavity when said slider member is in said second position, and permitted separation from said bar member and slider member.

5. The rack arm as defined in claim 4 wherein:

said upper lug and said lower lug of each passageway project into said passageway in opposition to terminate mid-way across said passageway wherein said lower lug separates said storage cavity from said release cavity.

6. A security rack arm comprising:

an elongated bar having a top and a bottom with a plurality of open slots arranged in fixed spaced apart relationship along said top;

a slider bar movably carried on said elongated bar having a top and a bottom with a plurality of apertures open through said slider bar top in spaced apart relationship along said slider bar top;

said slider bar having a pair of spaced apart lugs projecting into each of said apertures to define an upper release cavity and a lower storage cavity whereby a first passageway is defined about a lower lug of said pair communicating said storage cavity with said release cavity and a second passageway is defined about an upper lug of said pair communicating said release cavity with said slider bar top;

a manual lock mechanism carried on said slider bar and operable to move said slider bar between a first position and a second position; and said first position disposes said slider bar upper lug across said open slot in said elongated bar and said second position disposes said lower lug across said open slot in said elongated bar.

7. The rack arm as defined in claim 6 wherein:

said first position disposes said slider bar lower lug away from said open slot in said elongated bar and said second position disposes said slider bar upper lug away from said open slot in said elongated bar.

8. The rack arm as defined in claim 7 including:

a stop plate carried on said elongated bar;

said manual lock mechanism having a rotatable latch adapted to selectively bear against said stop plate to move said slider bar between said first and said second positions; and spring biasing means interconnected between said elongated bar and said slider bar to yieldably urge said slider bar into said first position.

* * * * *